US005366360A

United States Patent [19]

Bookbinder et al.

[11] Patent Number: 5,366,360

[45] Date of Patent: Nov. 22, 1994

[54] AXIAL POSITIONING LIMIT PIN FOR SCROLL COMPRESSOR

[75] Inventors: Mark J. Bookbinder, Detroit, Mich.; Michael E. Greene, Kettering, Ohio; Dwayne L. Johnson, La Crescent, Minn.; Christopher M. Bellinger; Susan C. Vasko, both of Lockport, N.Y.

[73] Assignee: General Motors Corporation, Detroit, Mich.

[21] Appl. No.: 150,311

[22] Filed: Nov. 12, 1993

[51] Int. Cl.[5] ..... F04C 18/04

[52] U.S. Cl. ..... 418/55.5; 418/57; 418/151

[58] Field of Search ..... 418/55.1, 55.5, 57, 418/151

[56] References Cited

U.S. PATENT DOCUMENTS

| | | | |
|---|---|---|---|
| 4,475,875 | 10/1984 | Sugimoto et al. | 418/55.1 |
| 4,808,094 | 2/1989 | Sugimoto et al. | 418/1 |
| 4,824,346 | 4/1989 | Hiraga et al. | 418/55.5 |
| 5,145,346 | 9/1992 | Iio et al. | 418/55.5 |

FOREIGN PATENT DOCUMENTS

| | | | |
|---|---|---|---|
| 59-126096 | 7/1984 | Japan | 418/57 |

*Primary Examiner*—John J. Vrablik
*Attorney, Agent, or Firm*—Patrick M. Griffin

[57] ABSTRACT

A scroll compressor for compressing a recirculated flow of a refrigerant fluid comprises a two-piece housing having a fixed scroll securely mounted therein. An orbital scroll is disposed in the housing and matingly operatively engages the fixed scroll. A rotatable drive shaft extends through the forward end of the housing and includes a radially offset, or eccentric, drive pin. A bushing is disposed on the drive pin and retained by a roller bearing centrally on the forward face of the orbital scroll. A counterweight is secured to the bushing. An axial limit pin extends integrally with the drive shaft and is fixed relative to the drive pin. The limit pin extends through an enlarged opening in the counterweight and abuts the forward face of the bushing. A C-type clip is seated in a groove on the distal end of the drive pin for axially retaining the bushing in place on the drive pin.

1 Claim, 2 Drawing Sheets

AXIAL POSITIONING LIMIT PIN FOR SCROLL COMPRESSOR

TECHNICAL FIELD

The subject invention relates to a scroll-type compressor having an orbital scroll and a fixed scroll, and more particularly to a scroll compressor having an improved connection between a rotary drive pin and the orbital scroll.

BACKGROUND ART

Scroll-type compressors are frequently used in automotive air conditioning systems to compress a recirculated flow of refrigerant fluid and move the fluid through a cooling circuit. The scroll compressor includes two involute or spiral wrapping scrolls. One of the scrolls is fixed in the compressor housing, whereas the other scroll is disposed for orbital movement relative to the fixed scroll for intaking low pressure fluid and discharging high pressure fluid. A rotary drive means extends outwardly from a forward end of the compressor for operative connection to a power take-off of the automotive engine. The drive means extends internally of the scroll compressor and terminates in a drive pin that extends axially off the drive means yet is radially offset, or eccentric, relative to the central rotation axis of the drive means. The end of the drive pin is received in an eccentric bore of a bushing, which, in turn, is centrally and rotatably disposed on the forward face of the orbital scroll. Therefore, as the drive means rotates in the housing, the drive pin forces the orbital scroll to orbit in a small circular path against the fixed scroll.

For smooth and proper operation of the compressor, the bushing must not be permitted to shift axially on the drive pin, otherwise the bushing will not fully engage the drive bearing of the orbital scroll and abnormal or excessive bearing wear will result. Additionally, the bushing and/or an adjacent counterbalancing counterweight may contact the drive pin during operation and result in objectionable noise or wear.

In order to axially retain the bushing on the drive pin, the prior art teaches to form an annular shoulder on the drive pin by reducing its diameter to form a shoulder against which one side of the bushing abuts to prevent relative axial movement in one direction. To prevent relative axial movement in the other direction, a C-type clip seated in an annular groove at the end of the drive pin abuts the opposite side of the bushing. Therefore, the bushing is sandwiched between the shoulder and the C-type clip. The primary deficiency of this prior art arrangement is that the strength of the drive pin is diminished by reducing its diameter to form the shoulder, and additional machining is required to form the shoulder. However, if the shoulder is not formed, the bushing will be permitted to shift axially forward on the drive pin, and thus result in partial engagement of the bushing and objectionable noise and wear, as described above. Also, the shoulder of the prior art drive pin acts as a stress concentrator thereby decreasing the rigidity of the drive pin. Further, the reduced diameter of the prior art drive pin caused by the formation of the shoulder results in a smaller bearing surface for the bushing, which has the undesirable effect of increasing the unit carrying load.

SUMMARY OF THE INVENTION AND ADVANTAGES

The subject invention provides a scroll compressor assembly of the type for compressing a recirculated flow of refrigerant fluid. The assembly comprises a compressor housing having a central axis, a fixed scroll, an orbital scroll operatively mated with the fixed scroll for receiving low pressure fluid and discharging high pressure fluid, a bushing rotatably secured to the orbital scroll, and a drive means at least partially disposed in the housing for orbitally driving the orbital scroll against the fixed scroll, with the drive means including an axially extending drive pin radially offset from the central axis and operatively engaged with the bushing. The improvement of the subject invention comprises an axial positioning means fixed relative to the drive pin and spaced from the drive pin for engaging the bushing and preventing movement of the bushing axially away from the orbital scroll.

The axial positioning means of the subject invention overcomes the disadvantages of the prior art connection between the drive means and the bushing. Specifically, the axial positioning means is spaced from, i.e., separate from, the drive pin for maintaining a minimum spacing between the drive means and the bushing. Whereas the prior art employs a shoulder formed on the drive pin to maintain a predetermined minimum spacing, the subject invention utilizes the separate axial positioning means. Therefore, the diameter of the drive pin does not need to be reduced to form the shoulder. Hence, rigidity of the drive pin is improved, and machining costs are reduced. Also, the increased drive pin diameter of the subject invention provides a larger bearing surface for the bushing which further reduces the unit carrying load. Further, the structural modifications of the subject invention permit a reduction in machining costs because the bushing can be easily machined as a simple screw machine part.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
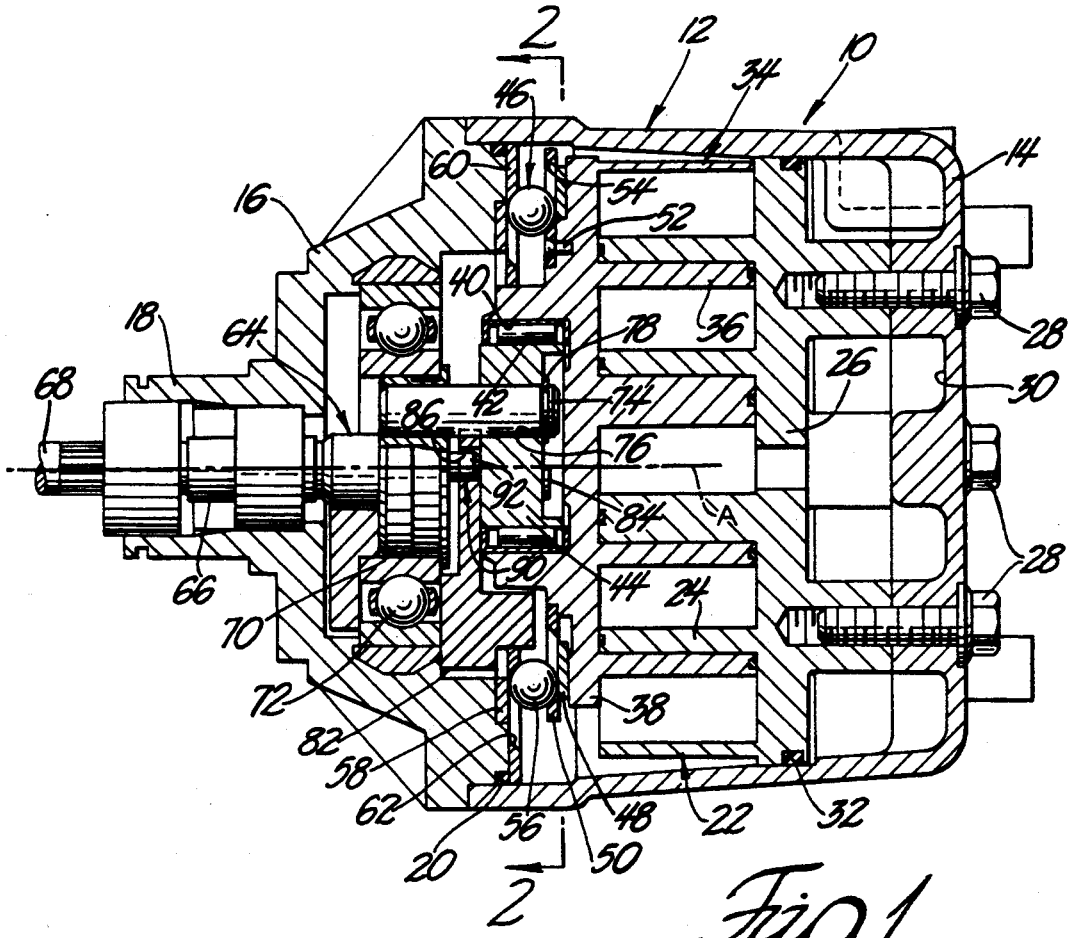
FIG. 1 is a cross-sectional view of a scroll compressor according to the subject invention.

Referring to the Figures, wherein like numerals indicate like or corresponding parts throughout the several views, a scroll compressor according to the subject invention is generally shown at (10) in FIG. 1. The compressor assembly (10) is of the type for compressing a recirculated flow of a refrigerant in an automotive air conditioning system having the normal condenser for condensing refrigerant gas into a liquid, orifice tube, evaporator, and accumulator arranged in that order between the compressor (10) discharge and suction sides. More particularly, the assembly (10) is engine mounted and driven by a flexible endless driving belt, e.g., a V-belt, directly from the automobile engine.

The compressor assembly (10) includes a compressor housing, generally indicated at (12) in FIG. 1, having a natural central axis A. The housing (12) is formed in two parts comprised of a rearward cup-like section (14) and a forward cap-like section (16). The forward section (16) includes a cylindrical boss (18) centered about the central axis A. A plurality of mounting brackets (not shown) extend outwardly from the housing (12) for securing the assembly (10) to the engine of an automobile. An O-ring seal (20) is provided at the juncture of the forward (16) and rearward (14) housing sections for perfecting and maintaining a fluid tight seal therebetween.

A fixed scroll, generally indicated at (22) is fixedly disposed in the housing (12). The fixed scroll (22) includes an involute or spiral rigid scroll wrap (24) extending integrally forwardly from a fixed base plate (26). A plurality of bolts (28) extend axially through the rearward section (14) and are threadably received in boss-like threaded sockets in the fixed base plate (26). A discharge cavity (30) is formed between the rearward section (14) and the rearward face of the fixed base plate (26) for receiving compressed refrigerant fluid and distributing the high pressure fluid to the air conditioning system. An O-ring seal (32) is disposed in an annular recess about the perimeter of the fixed base plate (26) for establishing a seal to prevent leakage of high pressure fluid from the discharge cavity (30).

An orbital scroll, generally indicated at (34) in FIG. 1, is orbitally disposed in the housing (12) about the central axis A and is operatively mated with the fixed scroll (22) for receiving low pressure fluid about the peripheries thereof and discharging high pressure fluid from the centers thereof to the discharge cavity (30.) The orbital scroll (34) includes an involute or spiral scroll wrap (36) extending from and supported rigidly by an orbital base plate 38. The forward surface of the orbital base plate (38) includes a centrally located cylindrical pocket (40). A roller bearing (42) is disposed in the cylindrical pocket (40) for rotatably supporting a bushing (44) and securing the bushing (44) to the orbital scroll (34).

An orbital thrust/anti-rotation assembly, generally indicated (46), is disposed between the orbital base plate (38) and the forward section (16) of the housing (12). The orbital thrust/anti-rotation assembly (46), shown in FIG. 1, includes an annular backrest plate (48) and an annular guide plate (50) fixedly secured to the forward face of the orbital base plate (38) by a plurality of fasteners (52). The guide plate (50) includes a plurality of equally radially and circumferentially spaced cups (54). Preferably, the guide plate (50) is provided with sixteen such cups (54).

A spherical roller ball (56) is disposed in each of the cups (54). Hence, in the preferred embodiment, sixteen such roller balls (56) are provided. The roller balls (56) are fabricated from a hardened steel such as typically used in ball bearings.

The orbital thrust/anti-rotation assembly (46) further includes a stationary backrest plate (58) and a stationary guide plate (60) disposed concentrically adjacent the stationary backrest plate (58). A corresponding number of stationary cups (62) are provided in the stationary guide plate (60) for receiving the roller balls (56). As the orbital scroll (34) orbits in the housing (12) about the central axis A, the orbital thrust/anti-rotation assembly (46) rollably supports the orbital scroll (34) and supports thrust loads while preventing rotation of the orbital scroll (34). The orbital thrust/anti-rotation assembly (46) also keeps the top edges of the scroll wraps (36), (24) in close proximity to the respective fixed (26) and orbital (38) base plates.

The compressor assembly (10) also includes a drive means, generally indicated at (64), at least partially disposed in the housing (12) for orbitally driving the orbital scroll (34) against the fixed scroll (22). The drive means (64) extends through the boss (18) and is rotatably supported by the forward housing section (16). The drive means (64) includes a drive shaft (66) having an exterior end (68) splined and threaded to securely receive a clutch driver (not shown). Alternatively, the pulley wheel could be keyed or pressed onto the exterior end (68) of the drive shaft (66). The drive shaft (66) extends into the housing (12) and terminates at an enlarged interior end (70). The interior end (70) is generally disc-shaped and is supported about its exterior periphery by a ball bearing (72).

The drive means (64) further includes an axially extending drive pin (74) securely retained on the interior end (70) of the drive shaft (66). Alternatively, the drive pin (74) could be machined integrally with the drive shaft (66). The drive pin (74) is radially offset from the central axis A so that as the drive shaft (66) rotates in the ball bearing (72), as well as in bearings supported in the boss (18), the drive pin (74) rotates about the central axis A.

Figure 3:
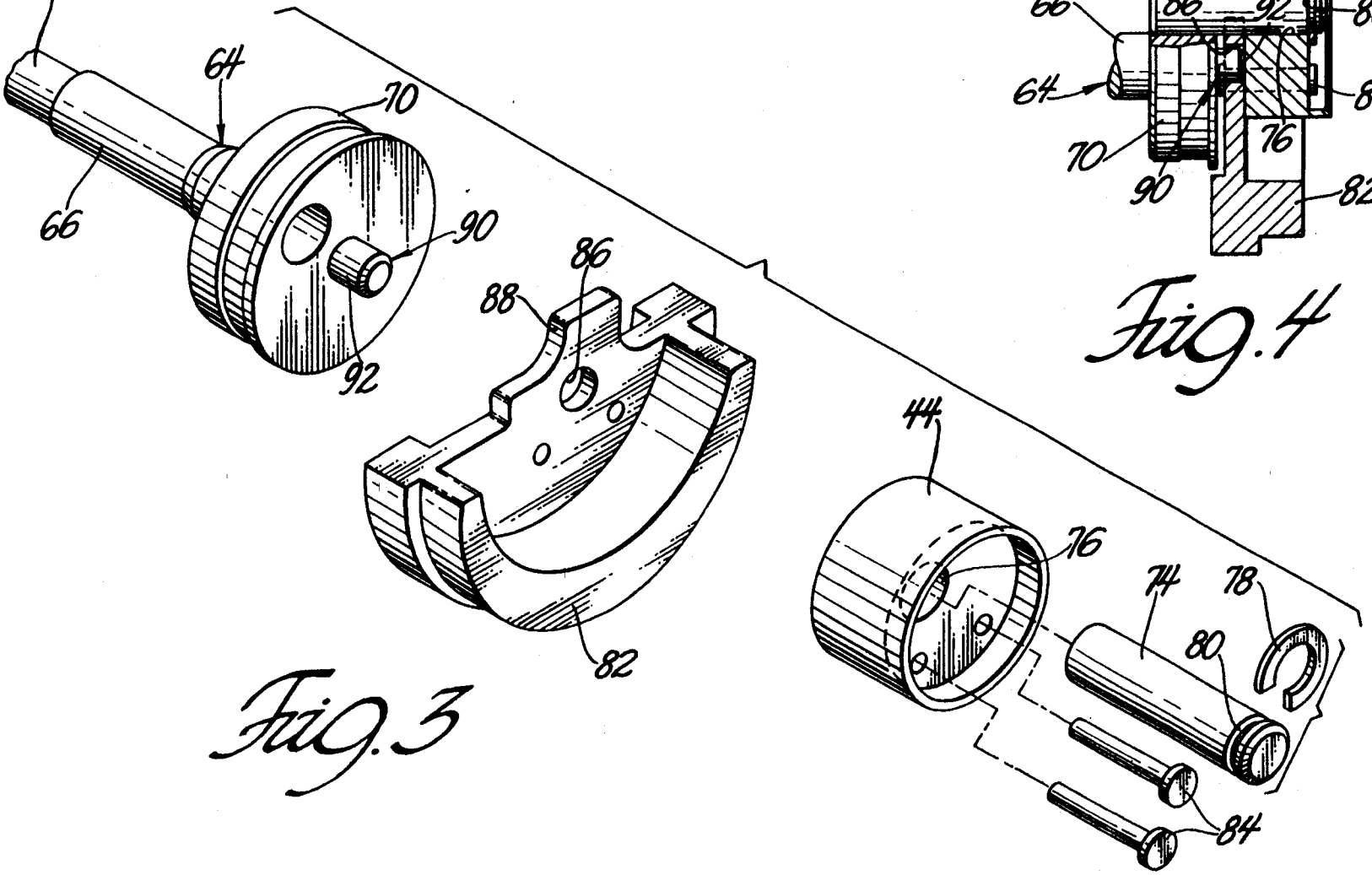
FIG. 3 is an exploded perspective view of the drive means, counterweight, bushing, and drive pin of the subject invention.

The drive pin (74) is operatively engaged with the bushing (44) so that movement of the drive pin (74) causes a corresponding movement of the bushing (44). More particularly, the bushing (44) includes an eccentrically positioned bore (76) extending completely therethrough. The cylindrical drive pin (74) is slidably retained in the eccentric bore (76) so as to permit only a slight rotational movement therebetween. The bushing (44) is prevented from sliding axially off the distal end of the drive pin (74) during operation by a C-type retainer clip (78) retained in an annular groove (80) about the distal end of the drive pin (74), as best shown in FIG. 3. Hence, the C-type clip (78) engages and bears upon the rearward surface of the bushing (44) during operation to prevent the bushing (44) from sliding axially off the end of the drive pin (74).

Figure 2:
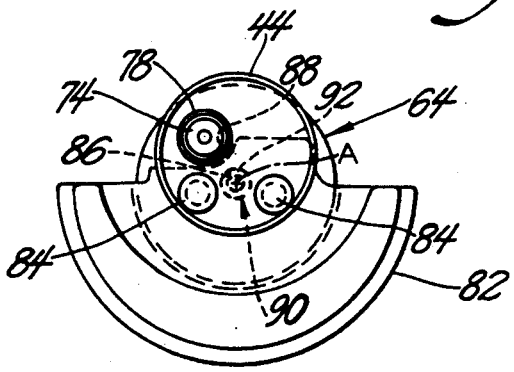
FIG. 2 is an end view of the bushing, counterweight and drive means according to the subject invention.
Figure 4:
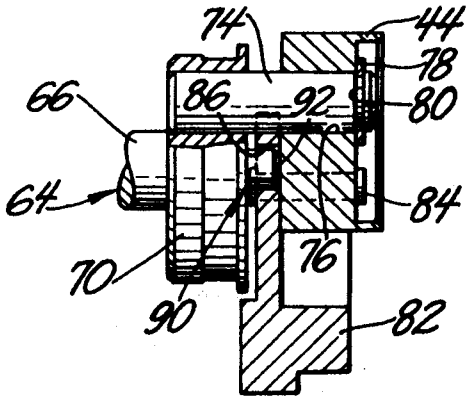
FIG. 4 is a side view in partial cross section of the drive means, counterweight, bushing, and drive pin of the subject invention.

A counterweight (82) is secured to the bushing (44) by a pair of rivets (84), as shown in FIG. 3. The counterweight (82) is provided with a cylindrical opening (86) which is aligned with the central axis A and covered at its rearward end by the bushing (44). A small arcuate notch (88) is provided in the counterweight (82) to allow for the drive pin (74), as shown best in FIG. 2. The counterweight (82) may be fabricated either from solid material or a plurality of laminated plates.

An axial positioning means, generally indicated at (90), is fixed relative to the drive pin (74) and spaced from the drive pin (74) for engaging the bushing (44) and preventing movement of the bushing (44) axially away from the orbital scroll (34) while limiting relative rotation between the drive means (64) and the bushing (44). More particularly, the axial positioning means (90) comprises a cylindrical pin (92) extending integrally from the drive means (64) and spaced radially from the drive pin (74). The pin (92) extends rearwardly from the interior end (70) of the drive shaft (66) and is aligned along the central axis A.

Pin (92) is received through the opening (86) in the counterweight (82), which has a diameter slightly larger than pin (92), enough so that about 3 or 4 degrees of relative rotation of bushing (44) relative to drive means (64), about drive pin (74), is possible. In the event a piece of dirt or liquid refrigerant slug or other foreign matter becomes trapped between the fixed scroll (22) and the orbital scroll (34) during operation, the slight play formed between the pin (92) and the enlarged opening (86) in the counterweight (82) will permit the obstruction to be passed over without significantly damaging the scroll wraps (24), (36).

The length of the pin (92) is predetermined so as to just engage the forward surface of the bushing (44) when the rearward surface of the bushing (44) just engages the C-type clip (78) secured about the distal end of the drive pin (74). Therefore the bushing (44) is sandwiched between the pin (92) and the C-type clip (78) on the drive pin (74) to prevent axial movement of the bushing (44) off of pin (74) in either direction, and limiting relative axial motion on the drive pin (74) to a controlled tolerance.

In comparison to the prior art, the subject axial position means (90) is particularly advantageous in that the diameter of the drive pin (74) does not need to be narrowed to form a shoulder, thereby improving the rigidity of the drive pin (74). Hence, the larger drive pin (74) is stronger and more rigid than the prior art drive pins. This is because the prior art shoulder acts as a stress riser for the drive pin, thereby lowering the fatigue life of the drive pin. The increased drive pin (74) diameter of the subject invention provides a larger bearing surface for the eccentric bore (76) of the bushing (44) which reduces the unit carrying load when compared to the prior art drive pin having a shoulder. Also, the manufacturing cost of the subject bushing (44) is greatly reduced because the bushing (44) can be fabricated from bar stock using a typical screw machine. The prior art bushing required an integral axial limit pin extending forwardly therefrom which made manufacture of the bushing much more costly and difficult. Further, axial position control of the subject bushing (44) is improved in comparison to the prior art because the pin (92) is positioned more closely to the geometric center of the bushing (44) than the prior art drive pin shoulder described above. This positioning of the pin (92) of the subject invention close to the geometric center of the bushing (44) results in a reduced tendency of the bushing (44) to cock on the drive pin (74) and thereby decreases side loading and binding on the drive pin (74). By reducing the tendency of the bushing (44) to cock and bind on the drive pin (74), the tolerance between the eccentric bore (76) and the drive pin (74) can be relieved somewhat, thereby reducing the manufacturing costs of the two components.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

The embodiments of the invention in which an exclusive property or privilege is claimed are defined as follows:

1. In a scroll compressor of the type having a housing with a central axis, and an orbital scroll with a cylindrical bearing that is eccentric relative to said central axis, an improved orbital scroll drive, comprising, a drive shaft rotatably mounted in said housing which is basically structurally coaxial to said central axis a cylindrical bushing disposed in said orbital scroll bearing and having a rearward facing surface that faces toward said orbital scroll, an opposed forward facing surface that faces toward said drive shaft, and a cylindrical bore eccentric to said central axis, a counterweight fixed to said bushing in abutment with said forward facing surface and located axially between said drive shaft and bushing, said counterweight having a cylindrical opening coaxial to said central axis that is covered by said bushing a central cylindrical axial locating pin integral to, and comprising the forwardmost portion of, said drive shaft said locating pin being received axially through said counterweight cylindrical opening and being of sufficiently smaller diameter so as to allow a relatively small motion therewithin in a direction normal to said central axis, and, a cylindrical drive pin separate from said drive shaft with a diameter that fits closely, but slidably through said bushing cylindrical bore and having a fastener at one end larger in diameter that said bushing cylindrical bore and an opposite end that is secured to said drive shaft so as simultaneously maintain said axial locating pin in abuttment with said bushing forward facing surface and said fastener in abuttment with said bushing rearward facing surface, whereby, prior to assembly of said compressor, said shaft may be machined by turning about a single axis, and after assembly, said bushing is completely axially located between said drive shaft locating pin and drive pin fastener, while said counterweight may rotate slightly relative to said drive shaft about said drive pin, limited by the confinement of said axial locating pin within said counterweight opening.

* * * * *